United States Patent [19]

Bald et al.

[11] Patent Number: 4,831,854

[45] Date of Patent: May 23, 1989

[54] STEEL STRIP DESCALER

[75] Inventors: Wilfried Bald, Hilchenbach; Karl-Ernst Boucke, Grevenbroich; Hans Römmen, Dormagen; Manfred Fritz, Erkrath; Friedrich Hollmann, Grevenbroich, all of Fed. Rep. of Germany

[73] Assignee: SMS Schloemann-Siemag Aktiengesellschaft, Dusseldorf, Fed. Rep. of Germany

[21] Appl. No.: 906

[22] Filed: Jan. 6, 1987

[30] Foreign Application Priority Data

Jan. 7, 1986 [DE] Fed. Rep. of Germany ..... 3600143

[51] Int. Cl.[4] ..... B21B 37/00; B21B 45/06

[52] U.S. Cl. ..... 72/8; 29/81 A; 72/11; 72/19; 72/21; 72/40; 72/234; 72/243; 72/247; 409/139

[58] Field of Search ..... 72/8, 21, 247, 243, 72/241, 19, 37, 11, 39, 40, 249, 234; 29/81 A, 81 R; 409/139

[56] References Cited

U.S. PATENT DOCUMENTS

| | | | |
|---|---|---|---|
| 2,012,849 | 8/1935 | Gardner et al. | 72/40 X |
| 4,162,627 | 7/1979 | Shida et al. | 72/247 |
| 4,519,233 | 5/1985 | Feldmann et al. | 72/241 X |
| 4,656,859 | 4/1987 | Ginzburg | 72/243 |

FOREIGN PATENT DOCUMENTS

| | | | |
|---|---|---|---|
| 1248600 | 8/1967 | Fed. Rep. of Germany . | |
| 2931229 | 6/1985 | Fed. Rep. of Germany . | |
| 0119609 | 9/1981 | Japan | 72/40 |
| 0003912 | 1/1985 | Japan | 72/40 |
| 0716662 | 2/1980 | U.S.S.R. | 72/40 |
| 0816600 | 3/1981 | U.S.S.R. | 72/40 |
| 1093379 | 5/1984 | U.S.S.R. | 72/40 |
| 0748196 | 4/1956 | United Kingdom | 29/81 A |

*Primary Examiner*—Robert L. Spruill
*Assistant Examiner*—Steven B. Katz
*Attorney, Agent, or Firm*—Herbert Dubno

[57] ABSTRACT

The rolling mill for mechanical descaling of hot rolled steel is constructed according to the slidable roll process with reducing rolls so that a unform operation with different and/or changing shape steel strips can obtained. This is attained when the rolling mill has at least two rolls slidable in opposite directions whose body surfaces are constructed with S-shape contours positioned inversely to each other so that these contours compliment each other flawlessly in one certain axial relative position. When sliding the rolls in opposite directions in one case the contour is decreased in the center region of the steel strip and when slid in the opposite directions in the other case the contour is increased in the center region. Thus the rolls can be adjusted to fit a gently convex steel strip profile by axially sliding the rolls in opposite directions as also rolled strips with a thickness centrally reduced in comparison to that of the edge regions can by appropriate sliding of the rolls opposite each other.

7 Claims, 3 Drawing Sheets

STEEL STRIP DESCALER

CROSS REFERENCE TO RELATED APPLICATION

This application is related to the commonly assigned copending application Ser. No. 000,905 filed concurrently herewith.

FIELD OF THE INVENTION

Our invention relates to a descaling mill for mechanical descaling of steel, particularly hot rolled steel strip by reducing rolls using a sliding roll process.

BACKGROUND OF THE INVENTION

With hot rolling of steel strip, hard surface oxide and/or scale layer forms which adheres rigidly to the metal surface of the strip.

Prior to the softening working processes for such steel strip, particularly in a cold rolling process, the scale layer should be removed to avoid a rolling of scale into the steel strip and the formation of surface deformaties or imperfections.

Ordinarily the scale layer is removed in a corrosive chemical bath. Usual scale thicknesses require long reaction and residence times so that an undesirably large size for the bath is necessary and both maintaining the desired bath concentration and later disposal of the bath fluid make for considerable difficulty.

A mechanical descaling by grinding or milling according to German Patent No. 886 585 does not take into consideration the profile of the steel strip so that metal from the middle of the steel strip is removed while scale may remain on the edge regions of the steel strip.

The exposure of the surface of the steel strip to abrasive particles and a waste water mixture has not proved effective so that also undesirably large lengths for the scale removal path were necessary and additionally the danger of damage to the strip surface existed (German Patent No. 28 31 229).

In an attempt to try to find a problemfree descaling for steel, a process has been set forth in German Printed Patent Application DE-AS No. 12 48 600 according to which the steel strip coming along the roll path runs through a reducing rolling mill under operation of a strong pulling force. To be able to apply the desired strong pulling force suitable roll arrangements causing the pulling force can be arranged before or after the rolling mill; nevertheless the effect is unsatisfactory.

According to the Soviet Patent document No. 560 657 an increased effectiveness for removal of scale should be attained when the reduction is performed under simultaneous bending and sliding according to the slidable roll process. The strip is slung about half way around the working rolls on entering and/or exiting; this has proven to be disadvantageous and a consideration of the strip profile is practically not possible so that with customary profiles the fitting of the roll gap is only limitedly possible at best.

OBJECTS OF THE INVENTION

It is an object of our invention to provide an improved apparatus for mechanical descaling of steel, particularly a steel strip, which avoids drawbacks of earlier methods.

It is also an object of our invention to provide an improved method and apparatus for mechanical descaling of a steel strip in which with the help of mechanically breaking, loosening and/or removal of the scale without disadvantages of slinging the strip around a roll.

It is another object of our invention to provide an improved apparatus for a preliminary mechanical descaling of steel strip which causes a reduction which can uniformly suit different and/or changing profiles of the steel strips and which especially can be used as a first stage to be followed by other descaling stages.

SUMMARY OF THE INVENTION

These objects and others which will become more readily apparent hereinafter are attained in accordance with our invention in a rolling mill for mechanical descaling of a hot rolled steel strip by reducing rolls according to a sliding roll process.

According to our invention the rolling mill has at least two slidable rolls of profiles complementing each other and axially sliding in opposite directions. The body surfaces of these rolls are provided with S-shape contours positioned inversely to each other, these contours completely flawlessly complementing each other (i.e. engaging without gap formation) in a certain axial position of the rolls and these working rolls having different mean peripheral speeds, i.e. average peripheral speeds across the lengths of the contours.

By use of different peripheral speeds corresponding to the slidable roll process a higher shearing and extension force is attained in the transformation region which causes a division and loosening of the scale layer.

The occurring roll forces are comparatively small so that on the one hand the rolling mill may carry the reduced load comparatively easily and firmly and on the other hand the tendency of scale pieces to be rolled into the surface of the strip is eliminated.

By axial slding of the rolls in opposite directions the profile of the roll gap can be adjusted to fit the steel strip so that the steel strip is rolled out uniformly over its entire width while simultaneously a stress-free steel strip is attained.

On the other hand it is also possible to set a predetermined roll gap profile by a predetermined further axial adjustment and to generate this profile of the rolled steel strip. By corresponding adjustment of the means peripheral speed of the working rolls the pulling force occuring upstreasm and downstream of the rolling mill on the steel strip is so determined that no special drive apparatus or at least no slinging around a roll is necessary to maintain it. The mean peripheral speed of the bodies of the rolls lies between the pure slip drive in which the roll is dragged by the strip and a speed in which the strip moves with a normal roll peripheral speed. Thus one roll can run with the strip input speed and the other with the strip output speed which can be the customary peripheral speed of the normal roll drive unit so that a mixed drive between normal and sliding rolling exists.

The mean peripheral speed corresponding to the speed at a medium or average radius portion to allow for the fact that a special S shape surface contour is present.

It has been found to be advantageous to adjust the profile of the roll gap to complement the steel strip shape by axially sliding the rolls with a special surface contour and by the use of the roll-bending devices.

This adjustment occurs appropriately in response to a control device which based on the measuring results of a plurality of detectors detecting the strip profile. This may be performed on successively fed steel strips by two or three rolling mills of this kind mounted following one another and operating according to the mixed slip/driven roll process.

Roll bending devices can also be provided for further improvement of the setting of the predetermined and/or desired shape of the steel strip. The rolling mills can be twin or multiple rolling mills such as four or six high rolling mills. Of course the working rolls are axially slidable and are provided with a special surface contour having the S-shape contour. With multiple roll rolling mills it is also possible to equip other rolls, for example the intermediate rolls, with such a surface contour and it is also possible to equip neighboring rolls like for example a working and an intermediate roll supporting it with complementary surface contours. Further it is also possible with a multiple roll rolling mill to provide two differently shaped special surface contours and to slide these rolls axially.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
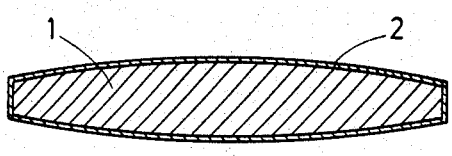
FIG. 1 is a transverse cross sectional view through a steel strip from which scale is to be removed.

In FIG. 1 a cross sectional view through a hot rolled steel strip 1 is shown in which both the thickness (relatively to the width) and thickness differences are shown magnified or exaggerated to provide a better illustration. The steel strip 1 has a symmetric profile with a thicker central region as it is usually rolled and which with its slight central enlargement has proved satisfactory, particularly on introduction into a rolling mill. The hot rolled steel strip 1 is coated by a layer 2 of scale which is removed before the subsequent cold rolling.

Figure 2:
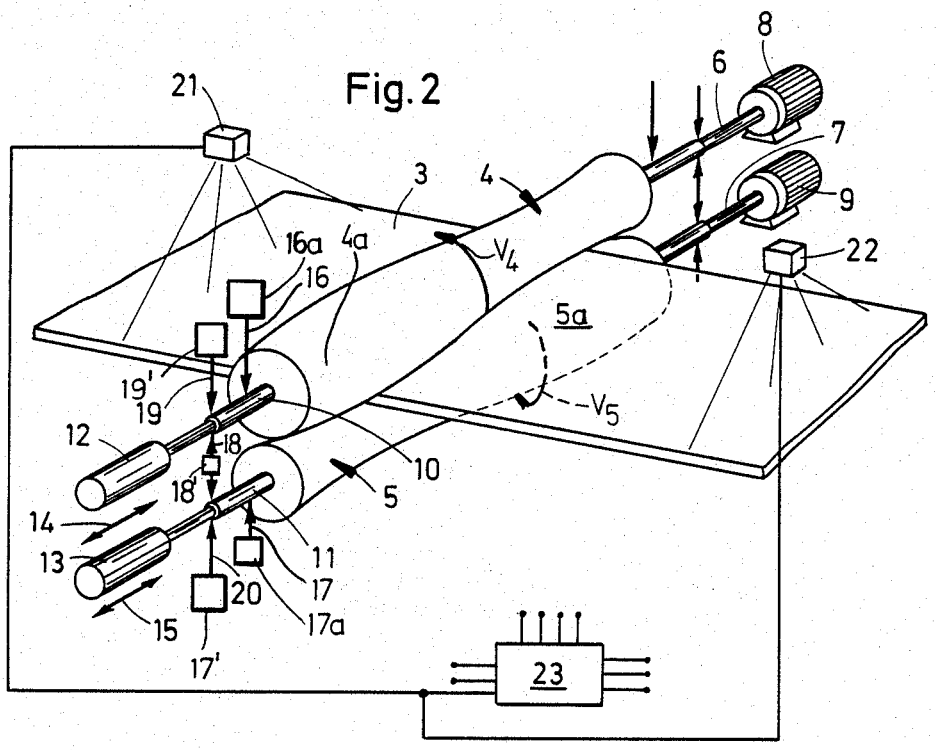
FIG. 2 is a perspecrtive schematic view of a rolling mill with positioning and control device for descaling according to our invention.

In FIG. 2 this steel strip indicated there with the reference character 3 is guided between the working rolls 4 and 5 of a partially illustrated rolling mill. The bodies 4*a* and 5*a* of these working rolls 4 and 5 are provided with a special surface contour which has a substantially S-shape contour and which is provided for both rolls positioned inversely with respect to each other so that their contours complement each other flawlessly in one position (i.e. interfit without a gap), as is described in the German Patent No. 30 38 865.

The working rolls 4 and 5 are driven by motors 8 and 9 by spindles 6 and 7, if necessary through a toothed gear unit so that they operate according to a sliding roll process especially to a mixed slipping roll process. The mean peripheral speed $V_4$ of one of the working rolls 4 is at least the entrance speed of the steel strip 3 while the other roll 5 has a peripheral speed $V_5$ which is at most the outlet speed of the steel strip 3. These speed relationships can be caused by suitable operation of the motors or of one of the motors using the other as a generator. It is also possible to provide a mechanical intermediate gear which can be a differential gear coupling the rolls for this purpose.

On the free roll pins 10 and 11 hydraulic cylinders 12 and 13 can engage, which, when acting in opposite directions, can cause sliding of the working rolls 4 and 5 in opposite directions in the direction of the arrows 14 and 15. The spindles 6 and/or 7 operated by the drive are appropriately telescoping to faciliate the roll slidability or engage the nonrotatable and axially slidable corrugated rolls (comb rolls) of a corrugated rolling (comb roll) mill.

The positioning devices 16*a* and 17*a* are not shown in detail and the positioning force they exert on the working rolls 4 and 5 are indicated the the arrows 16 and 17. Further structural components 18' to 20' engage on the roll pins 10 and 11 to provide a bending force which is illustrateed by the arrows 18 to 20 and can be directed positively and negatively.

Detectors 21 and 22 are provided at the inlet and outlet side trained at the steel strip 3, and both are optical sensors in the illustrated embodiment and detect the strip surface and with it the profile. The control device 23 is illustrated as a block, the output signal of the detectors being fed from the left, on the top side of the control device 23 the actual value of the axial sliding, the positioning displacement, the positioning and the bending forces as well as the peripheral speed of the working rolls being fed, while the regulating signals for these values for planar and/or tension free steel strips are fed from the right side of the control device 23.

As required the working rolls are appropriately slid about equal amounts in opposite directions and the control device adjusts the positioning device and also the bending force as well as the peripheral speed. As required the design of a preselected profile can be introduced by an additional manual engagement or by data transmission.

The details provided in the drawing serve only for illustration. Thus appropriately the apparatus is constructed on the drive side additionally to slide the working rolls in opposite directions. The stand supporting the working rolls can like the roll bending device be designed in a standard and conventional way. Similarly the invention is not limited to the illustrated two roll rolling mill. The shown small diameter of te working rolls corresponds much more to a four or six high rolling mill although also three and five roll rolling mills are possible. These rolls can arbitrarily have a special body surface contour and the other rolls can be cylindrical or slightly curved. It is however also possible for example to equip four rolls with appropriately different special surface contours to provide additional variability for the roll gap by axial sliding the rolls.

In every case at least a tearing up, partial removal of the scale layer with a low roll force is effected with reduction of the rolled steel strip by at least 4% by the descaling process, so that the subsequent corrosive chemical bath need not remove the entire thickness of the original scale layer but can involve a substantially shorter treatment period since only the remaining residual scale need be removed.

This also reduces the danger of overtreatment of the already exposed metal surface and similarly makes easy the regeneration of the corrosive fluid and the disposal of the excess fluid. Since the rolls are positioned along a linear path of the steel strip no difficulties exist along the roll line of the steel strip and particularly the introduction and/or the first pass is greatly simplified.

The breaking up of the scale, particularly however the removal of the scale layer can be improved while retaining the desired profile, since two or more of the rolling mills are positioned in succession and if necessary an additional improvement is possible by providing special grinding devices (see the aformentioned application).

Figure 3:
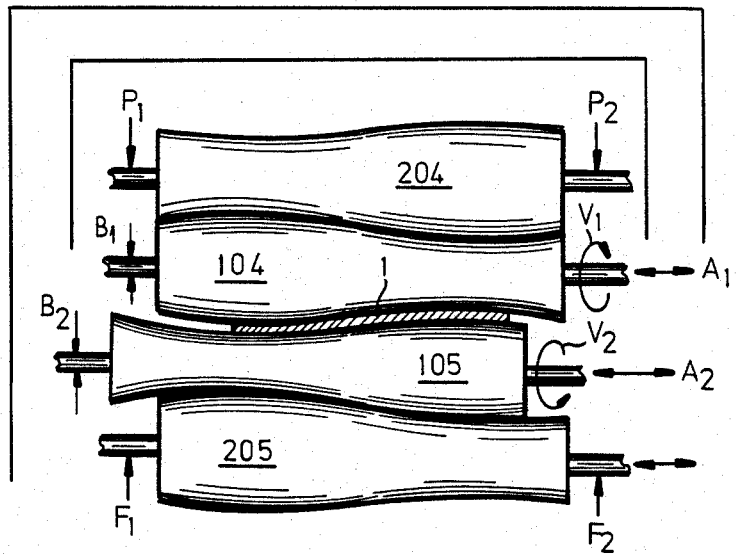
FIG. 3 is a vertical elevational view of a scale-removing stand provided along a scale-removing line for hot-rolled strip according to another embodiment of the invention.
Figure 4:
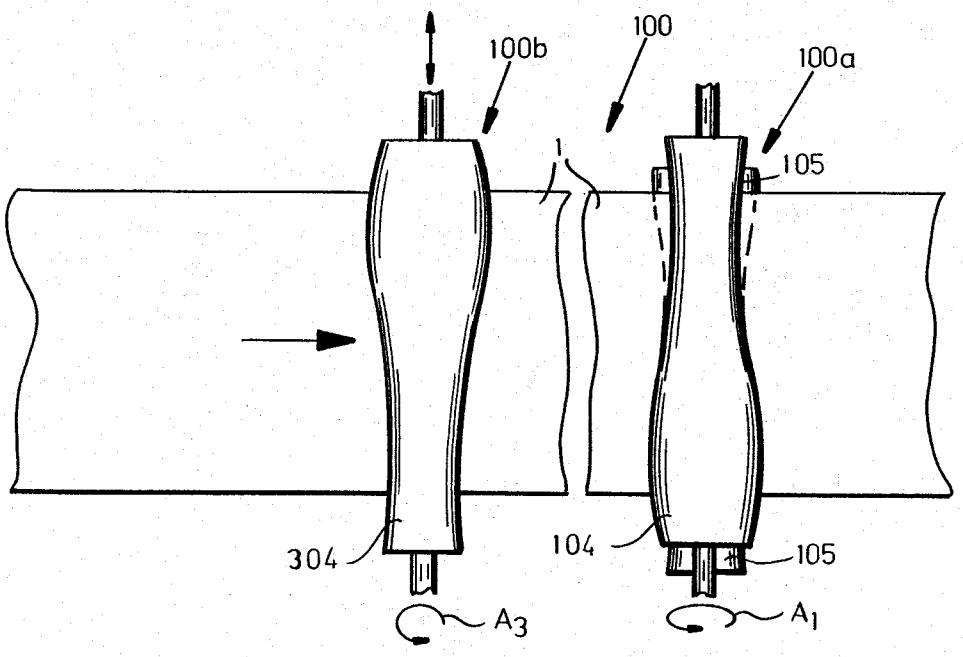
FIG. 4 is a plan view showing an arrangement of the scale-removing rolls for two sets of working rolls provided along the line of FIG. 3, the backup rolls having been omitted and the stands not shown.

In FIGS. 3 and 4 we have diagrammatically shown a modification of the scale-removing line of FIG. 2. As is diagrammatically illustrated in FIG. 4, the holl-rolled strip 1 can be descaled in a scaling line consisting of at least two sets of descaling rolls 100*a* and 100*b* along the path of the hot-rolled strip 1.

The bottle-shaped rolls 104, 105 are equivalent to the rolls 4 and 5 described in connection with FIG. 2 and thus have shallow S-shaped curvatures on their strip-engaging bodies; they can be shifted axially as represented by arrows $A_1$ and $A_2$, are driven at different mean peripheral velocities $v_1$ and $v_2$ which differ from the linear speed of the strip as well, can be subjected to roll-bending forces $B_1$ and $B_2$ to vary the nip contour, as is common in rolling mill stand permitting roll bending, and are urged against the strip by forces $P_1$, $P_2$, $F_1$ and $F_2$, the forces $P_1$ and $P_2$ representing downward forces generated at the stand and the forces $F_1$ and $F_2$ representing upward reaction forces. The latter forces can be applied through backup rolls in a four-high or six-high stand.

Upsteam of the descaling rolls 104, 105, another set of descaling rolls 100b with similarly shaped rolls 304, etc. can be provided, the peripheral speeds of the strip-engaging rolls of this set also having speeds different from one another and from the linear speed of the strip.

As is apparent from FIG. 3, both sets of rolls can include a stand S and the descaling rolls, e.g. the rolls 104, 105, and backup rolls, e.g. 204, 205 which are urged toward one another and also can be reciprocally shiftable with respect to the respective backed-up descaling roll.

We claim:

1. An apparatus for the mechanical descaling of a hot rolled steel strip comprising a plurality of rolling mills positioned along a linear path of a steel strip to be descaled, each of said rolling mills comprising:

a pair of bottle-shaped reducing rolls receiving said steel strip between them and rotatable about respective axes of rotation in opposite directions;

means for shifting said rolls axially opposite to one another said rolls being positioned inversely to one another and shaped so that said rolls flawlessly complement each other in a predetermined axial position of said rolls with no gap between them;

means for applying bending forces to said rolls;

respective driving means for each other of said rolls having different speeds and having a respective drive shaft, so that said bottle-shaped rolls are mounted on respective shafts and are rotated at different means peripheral speeds generating shear between said reducing rolls and said steel strip to be descaled;

means for controlling an axial shift of said rolls, bending forces and angular speed of each of said reducing rolls.

2. The apparatus defined in claim 1 wherein said driving means includes means for rotating said one of the said reducing rolls at least at a speed of an inlet linear velocity of said strip and the other reducing roll is rotatable at most at an outlet velocity of said strip, so that the speed of said other roll is greater than that one of said roll rotatable at least at the speed of the inlet velocity.

3. The apparatus defined in claim 1 wherein said means for controlling comprise a plurality of detectors responsive to contour of said strip.

4. The apparatus defined in claim 1 wherein said bottle-shaped rolls have S-shaped contours.

5. The apparatus defined in claim 1, further comprising a control device generating control signals for changing said speed, bending force and axial shift of said reducing rolls.

6. The apparatus defined in claim 5 wherein each of said rolling mills further comprises a respective backup roll braced against each reducing roll.

7. The apparatus defined in claim 6 wherein said backup rolls are bottle-shaped rolls.

* * * * *